US007473108B2

(12) United States Patent
Lappöhn

(10) Patent No.: US 7,473,108 B2
(45) Date of Patent: Jan. 6, 2009

(54) MULTI-POLE PLUG-IN CONNECTOR

(75) Inventor: Jürgen Lappöhn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/801,724

(22) Filed: May 10, 2007

(65) Prior Publication Data

US 2008/0032525 A1 Feb. 7, 2008

(30) Foreign Application Priority Data

Aug. 4, 2006 (DE) ..... 10 2006 036 917

(51) Int. Cl.
*H01R 12/00* (2006.01)

(52) U.S. Cl. ..... 439/79

(58) Field of Classification Search ..... 439/608, 439/941, 79, 701

See application file for complete search history.

(56) References Cited

U.S. PATENT DOCUMENTS 5,077,893 A * 1/1992 Mosquera et al. ..... 29/882
5,112,233 A 5/1992 Lybrand
5,722,861 A 3/1998 Wetter
5,961,355 A 10/1999 Morlion et al.
6,196,886 B1 3/2001 Sato
6,475,041 B1 11/2002 Lappöhn et al.
6,551,140 B2 * 4/2003 Billman et al. ..... 439/608
2005/0020109 A1 1/2005 Raistrick et al.

FOREIGN PATENT DOCUMENTS

DE 43 30 390 3/1995
DE 20 2005 020 474 U1 3/2006

OTHER PUBLICATIONS

German Office Action with partial translation.

* cited by examiner

*Primary Examiner*—Ross N Gushi
(74) *Attorney, Agent, or Firm*—Collard & Roe, P.C.

(57) ABSTRACT

The invention relates to a multi-pole plug-in connector (10) having contact elements (16) which comprise a flat plug-in area (30) that transitions to a flat conduction area (18) the wide side (50) of which lies in a contact column plane (14). The wide side (31) of the flat plug-in area (30) is rotated by a predefined angle (70) relative to the wide side (50) of the flat conduction area (18). The plug-in connector (10) according to the invention is especially suited for making plug-in connections for transmission of high-frequency signals, especially in high-frequency digital signal transmission, where the data transfer rate may be over 10 GBit/s.

12 Claims, 6 Drawing Sheets

MULTI-POLE PLUG-IN CONNECTOR

CROSS REFERENCE TO RELATED APPLICATIONS

Applicant claims priority under 35 U.S.C. §119 of German Application No. 10 2006 036 917.3 filed Aug. 4, 2006.

PRIOR ART

The present invention relates to a multi-pole plug-in connector according to the preamble of the independent claim.

A multi-pole multi-row plug-in connector meeting high demands with respect to electric and mechanical parameters has been described in Utility Patent DE 20 2005 020 474 U1. That prior plug-in connector is especially suited for making plug-in connections for transmission of high-frequency signals. In digital signal transmission, the data transfer rate may be in the GBit/s rate, for example. Given the fact that in the case of high signal frequencies, the high-frequency characteristics of plug-in connections are of considerable importance, a flat screening element is provided for the signal-carrying contact elements that has an especially convenient design for being soldered easily onto a printed board by THR (through-hole reflow) technology.

U.S. patent application No. 2005/0020109 A1 describes a multi-pole multi-row plug-in connector where differential signals are carried by pairs of two contact elements arranged one above the other and adjacent each other in a plane of the contact column. Due to the particular arrangement of such contact elements, little crosstalk is encountered between neighboring contact elements located farther away, which likewise carry differential signals. The spacing between each pair of neighboring contact elements arranged one above the other is determined with a view to obtaining low throughput attenuation and little crosstalk between the respective pairs of contact elements that carry the differential signal.

U.S. Pat. No. 6,196,886 B1 discloses a plug-in connector similar to that described in US 2005/0020109 A1, where little crosstalk is obtained between different pairs of contact elements each carrying differential signals without any special screening measures by simply arranging the pairs of contact elements, located in neighboring contact element columns, in offset arrangement one relative to the other so that they come to lie in different contact row planes.

German Patent No. 43 30 390 C2 describes a contact element which has a plug-in area that contains a contact spring. The contact spring has two spring legs that extend from a connection member of the legs in a direction opposite to the plugging direction. The forward ends of the two spring legs are each provided with a contact tip that is formed by a bend in the spring legs by at least approximately 90 degrees. The two contact tips provide a contact inlet for pushing in a corresponding pin element that is retained in position by the contact tips.

Now, it is the object of the present invention to provide a multi-pole plug-in connector that provides high mechanical stability in addition to good high-frequency characteristics.

That object is achieved by the features defined in the independent claim.

DISCLOSURE OF THE INVENTION

The multi-pole plug-in connector according to the invention comprises contact elements having a flat plug-in area that transitions to a flat conduction area the wide side of which lies in a contact column plane. It is intended in this respect to have the wide side of the flat plug-in area rotated by a predefined angle relative to the wide side of the flat conduction area.

As a result of the described rotation, the contact element of the plug-in connector according to the invention provides a high bending moment or torque. Compared with the contact element known from the prior art, the novel contact element can be produced with reduced consumption of materials for an identical bending moment.

An essential advantage is achieved by the fact that less space is required in the plug-in area of the contact element. It is, therefore, possible to provide multi-pole plug-in connectors with a high number of plug-in contacts related to the surface area available.

In addition to the advantageous mechanical characteristics, the favorable high-frequency characteristics of the multi-pole plug-in connector according to the invention are of central importance. The invention achieves low throughput attenuation and, at the same time, high return loss. Little crosstalk is regarded as an especially favorable factor.

Due to the reduced spacing between two plug-in areas of two contact elements, arranged one adjacent the other in one contact column plane, preferably at a defined spacing one relative to the other, an additional flat screening is no longer needed. The field lines between two plug-in areas, arranged one adjacent the other in the contact column plane, extend mainly in the space between the two plug-in areas so that the resulting stray field is only small. Omission of the screening elements previously needed allows the plug-in connector to be given a smaller design, which at the same time results in reduced consumption of material.

As a result of the possibility now provided to vary within a wide range the spacing between two plug-in areas of the contact elements of the plug-in connector, arranged one adjacent the other in one contact column plane, especially to reduce that spacing, it is now possible to purposefully adjust the surge impedance, in addition to the screening rate. Especially, it is now possible to adapt the surge impedance of the plug-in connector to the surge impedance of the lines to be connected so that almost no mismatch will occur in the area of the plug-in connector. This guarantees high signal integrity and/or good signal quality.

The multi-pole plug-in connector according to the invention is optimally suited for connecting differential signal lines of the kind used especially in serial interfaces. Depending on the alternating application of signals to the plug-in contacts, for example of differential signals and signal ground, the plug-in connector according to the invention is capable of carrying high-frequency signals up to the GHz range and/or data transmission rates of over 10 GBit/s.

The mechanical and electric advantages of the plug-in connector according to the invention are achieved without any additional consumption of materials, compared with the plug-in connector known from the prior art. This results in particular cost advantages in series production of the plug-in connector according to the invention.

Advantageous embodiments and further developments of the multi-pole plug-in connector according to the invention will be apparent from the dependent claims.

Conveniently, the predefined angle is fixed at 90 degrees, at least approximately. This allows the spacing between plug-in areas arranged one adjacent the other in one contact column plane to be reduced to a minimum. In addition, the plug-in connector can be realized in an especially easy way.

According to an especially advantageous embodiment at least two contact elements are arranged one adjacent the other in one contact column plane and the wide side of the plug-in areas, especially the width of the wide side and the spacing between the two plug-in areas are matched one to the other, at least by sections. These measures allow the screening rate on the one hand and the surge impedance on the other hand to be purposefully influenced according to specified requirements.

One embodiment provides that the plug-in area comprises a spring element having two spring legs. Preferably, the cross-section of the spring legs diminishes substantially continuously, at least in partial areas, from a connection member of the spring legs in a direction opposite to the plug-in direction. The reduction of the cross-sectional area provided at least in partial areas permits the clamping force to be influenced purposefully, with a minimum of material input.

According to another embodiment, a stepped reduction in cross-section, in a direction opposite to the plug-in direction, is provided in the area of the spring legs. The stepped reduction in cross-section likewise contributes toward purposefully influencing the clamping force, with a minimum of material input, and at the same time allows a transition to be realized initially within a plug-in area and then to the conduction area of contact elements that have larger cross-sections in order to permit higher forces to be absorbed during the plugging operation.

Preferably, the two spring legs lie in one contact row plane. This allows the spring elements to be given a symmetrical design.

Preferably, contact tips are provided on the forward ends of the spring legs, for fixing and contacting corresponding contact elements of a corresponding plug-in connector.

Further embodiments relate to both the plug-in area and the conduction area of the contact element. The plug-in area and/or the conduction area may each comprise at least one locking element which in the assembled condition of the plug-in connector according to the invention coacts with recesses in a housing of the plug-in connector, thereby imparting to the plug-in connector high pull-out strength.

According to another embodiment, at least one offset is provided in the contact column plane in the conduction area, which permits a flexible arrangement of the conductors of the conduction area in the contact column plane.

According to another embodiment, a solder area is provided following the flat conduction area of the contact elements, which preferably comprises a SMD solder termination (surface-mounting device) for soldering the contact element to the surface of a printed board. SMD soldering of the plug-in connector according to the invention not only allows rational and, thus, low-cost soldering of the plug-in connector, but additionally permits the connection with a printed board to be given good high-frequency characteristics.

Certain embodiments of the invention are illustrated in the drawing and will be described hereafter in more detail.

Figure 1:
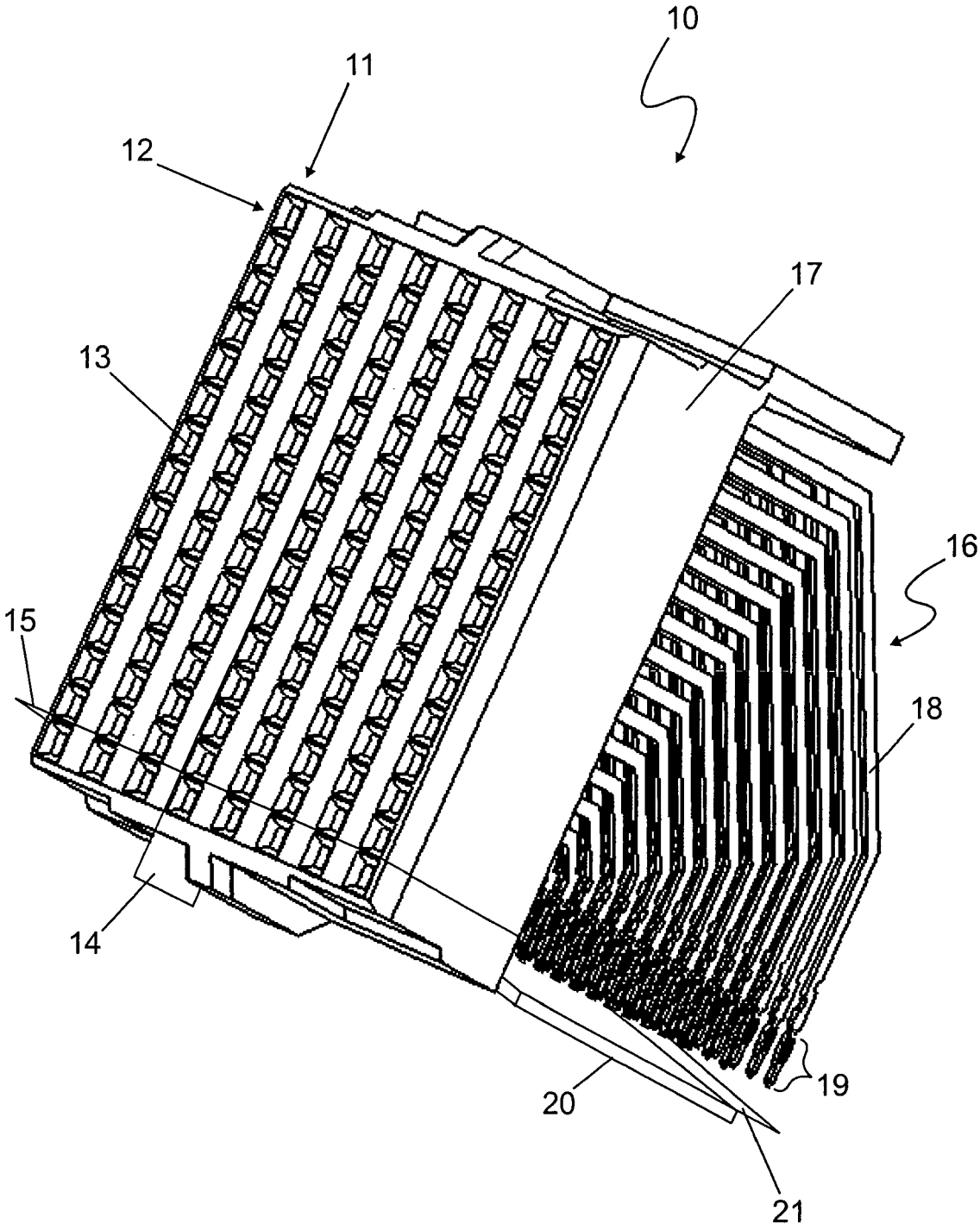
FIG. 1 shows a perspective view of a multi-pole plug-in connector.

FIG. 1 shows a perspective view of a plug-in connector 10 comprising a plurality of plug-in contacts 13 arranged in a plug-in contact column 11 and in a plug-in contact row 12. The plug-in contacts 13 arranged in the plug-in contact column 11 each lie in a contact column plane 14, while the plug-in contacts 13 arranged in the plug-in contact row 12 lie in a contact row plane 15.

The plug-in contacts 13 are each formed by contact elements 16, each comprising a plug-in area, arranged in a housing 17 of the plug-in connector and, therefore, not visible in FIG. 1, further a flat conduction area 18 and a solder area 19. The solder area 19 is intended for being soldered to a printed board 20 that extends in a printed board plane 21.

Figure 2:
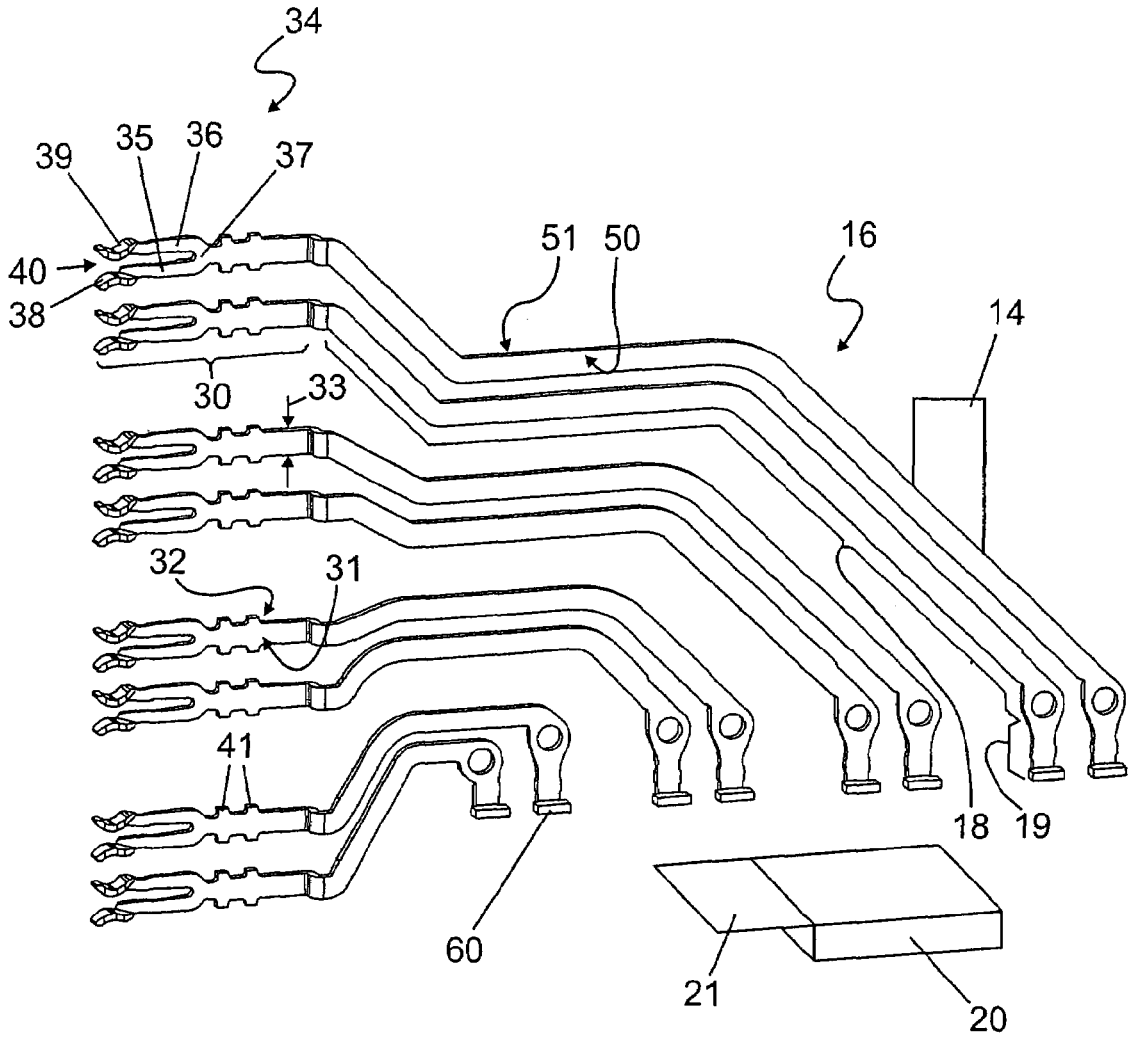
Fig.2 PRIOR ART
FIG. 2 shows a perspective view of contact elements of a multi-pole plug-in connector according to the prior art.

FIG. 2 shows a perspective view of contact elements that do not, however, comprise the essential feature of the invention. Although, accordingly, the contact elements shown in FIG. 2 correspond to the prior art, those parts of the contact elements that correspond to the respective parts of the contact elements 16 according to the invention will be described hereafter by way of explanation.

In FIG. 2, a flat plug-in area 30 is shown to have an at least approximately rectangular cross-section, for example, so that a wide side 31 and a narrow side 32 of the plug-in connector 30 are obtained, the wide side 31 having a predefined width 33, at least by sections. According to the prior art, the wide side 31 of the plug-in area 30 extends in the contact column plane 14.

Provided in the plug-in area 30 is a contact spring 34 which comprises a first and a second spring leg 35, 36 that are connected one to the other via a spring leg connection member 37. Contact tips 38, 39 formed on the forward ends of the two spring legs 35, 36 form together a contact inlet in the plug-in direction 40 of the plug-in connector 10.

In the plug-in area 30, there is provided at least one locking element 41 for the plug-in area which, after assembly of the contact element 16 in the plug-in connector housing 17, engages a corresponding recess provided in the plug-in connector housing 17 thereby helping increase the mechanical stability, especially increasing the pull-out strength.

The plug-in area 30 is followed by the flat conduction area 18, which likewise has an at least approximately rectangular cross-section, for example, so that a wide side 50 and a narrow side 51 are obtained for the conduction area 18.

The solder areas 19, which for example comprise SMD connections 60 for being soldered to a printed conductor structure on the printed board 20, not shown in detail, are provided at the rear ends of the contact elements 16.

Figure 3:
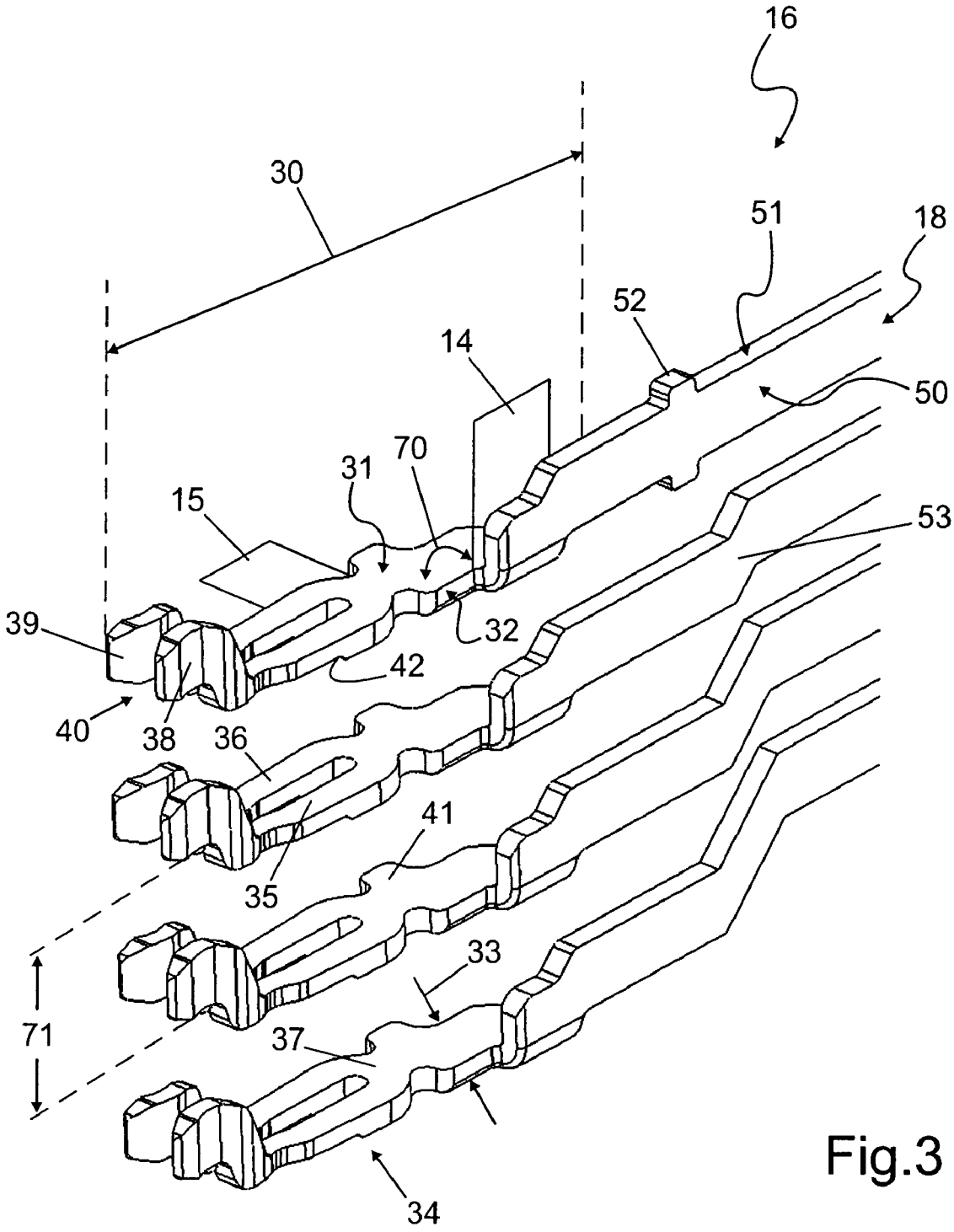
FIG. 3 shows a perspective view of contact elements of a multi-pole plug-in connector according to the invention.

FIG. 3 shows a perspective view of the contact elements 16 having the design provided according to the invention. Those elements in FIG. 3 that correspond to the respective elements shown in connection with the previous figures are indicated by the same reference numerals, respectively.

It is envisaged by the invention that the wide side 31 of the plug-in area 30 is rotated by a predefined angle 70 relative to the wide side 50 of the conduction area 18 of a contact element 16.

The value of the angle 70 can be adjusted to the expected space required for spreading out the contact tips 38, 39 when establishing contact with the corresponding contact element of the corresponding plug-in connector, taking into account the spacing 71 between two contact elements 16 arranged one adjacent the other in the direction of the plug-in contact column 11. An especially convenient solution is obtained when the angle 70 is determined to be at least approximately 90 degrees. In this case, the wide side 31 of the plug-in area 30 extends at least approximately in parallel to a contact row plane 15. In the soldered condition of the plug-in connector 10 on the printed board 20 the contact row plane 15 preferably extends in parallel to the plane 21 of the printed board.

Rotation by the predefined angle 70 of preferably 90 degrees initially allows the spacing 71 between two contact elements 16, arranged one adjacent the other in the contact column plane 14, to be reduced as the spring legs 35, 36 with the contact tips 38, 39 formed thereon, if any, are no longer spread out in a direction parallel to the contact column plane 14, but rather in a direction defined by the angle 70 during contact-making. Provided the angle has the preferred value of at least approximately 90 degrees, such spreading-out during contact-making occurs at least approximately in the contact row plane 15. As a result of the space savings that are rendered possible in this case, a comparatively higher number of plug-in contacts 13 can be accommodated within the predefined dimensions of the plug-in connector housing 17.

A special advantage achieved by an angle of at least approximately 90 degrees results from the fact that the sides 31 placed one opposite the other in at least approximately parallel arrangement are the wide sides 31 of the plug-in areas 30 of contact elements 16 arranged one adjacent the other in a contact column plane 14. This provides substantial advantages in terms of electric field distribution, depending on the signals carried through the contact elements 16. Especially, a low stray field is obtained as the field lines mainly occur between the wide sides 31 of two contact elements 16 arranged one adjacent the other in the contact column plane 14. Thus, an especially good screening effect is achieved without any need for special additional screening measures.

By adapting the spacing 71 to the wide side 31 of the plug-in area 30, which exhibits the width 33 at least by sections, or that exhibits the average width 33, at least approximately, it is possible in an especially advantageous way to purposefully influence the surge impedance determined by the conductor arrangement (and the dielectric) formed at least by two contact elements 16 arranged one adjacent the other in the contact column plane 14. Such adaptation is generally performed between the space 71 and the wide side 31 of the plug-in area 30. Specifically, such adaptation may be effected between the spacing 71 and the width 33 of the plug-in area 30, defined at least by sections. It is thereby possible to keep any variation in surge resistance in the area of the plug-in connection as small as possible in order to prevent undesirable line reflections. One thereby obtains good signal quality and/or high signal integrity.

Rotation by the predefined angle 70 leads to increased rigidity of the contact element 16. It is thus possible for the contact element 16 to absorb higher forces during the plugging operation without any risk of bending, especially in the conduction area 18. Especially, an increased torsion moment is obtained without increasing the input of material, compared with the contact elements known from the prior art.

By purposefully predefining the cross-section of the spring legs 35, 36, it is possible to purposefully influence the force to be applied during the plugging operation. Especially, it is envisaged to continuously reduce the cross-section of the spring legs 35, 36, at least by sections, from the connection member 37 in a direction opposite to the plugging direction 40. This minimizes the consumption of material.

According to another feature that aims at influencing the rigidity of the contact element 16, especially in the plug-in area 30, a stepped reduction 42 in cross-section is provided in the area of the spring legs 35, 36.

FIG. 3 contains further configurations that relate to the conduction area 18. Preferably, at least one conduction-area fixing element 52 is provided in the conduction area 18. The conduction-area fixing element 52 is intended to coact with a recess provided in the plug-in connector housing 17 in order to contribute toward increasing the mechanical stability, especially toward increasing the pull-out strength of the plug-in connector 10.

FIG. 3 further shows at least one offset 52 provided in the conduction area 18 of the contact element 16 and extending in the contact column plane 14. The neighboring contact elements 16, extending in a contact column plane 14, may have differently configured offsets 53. The at least one offset 53 allows the spacing of the contact elements 16 in the conduction area 18, not shown in detail in FIG. 3, to be varied.

Figure 4:
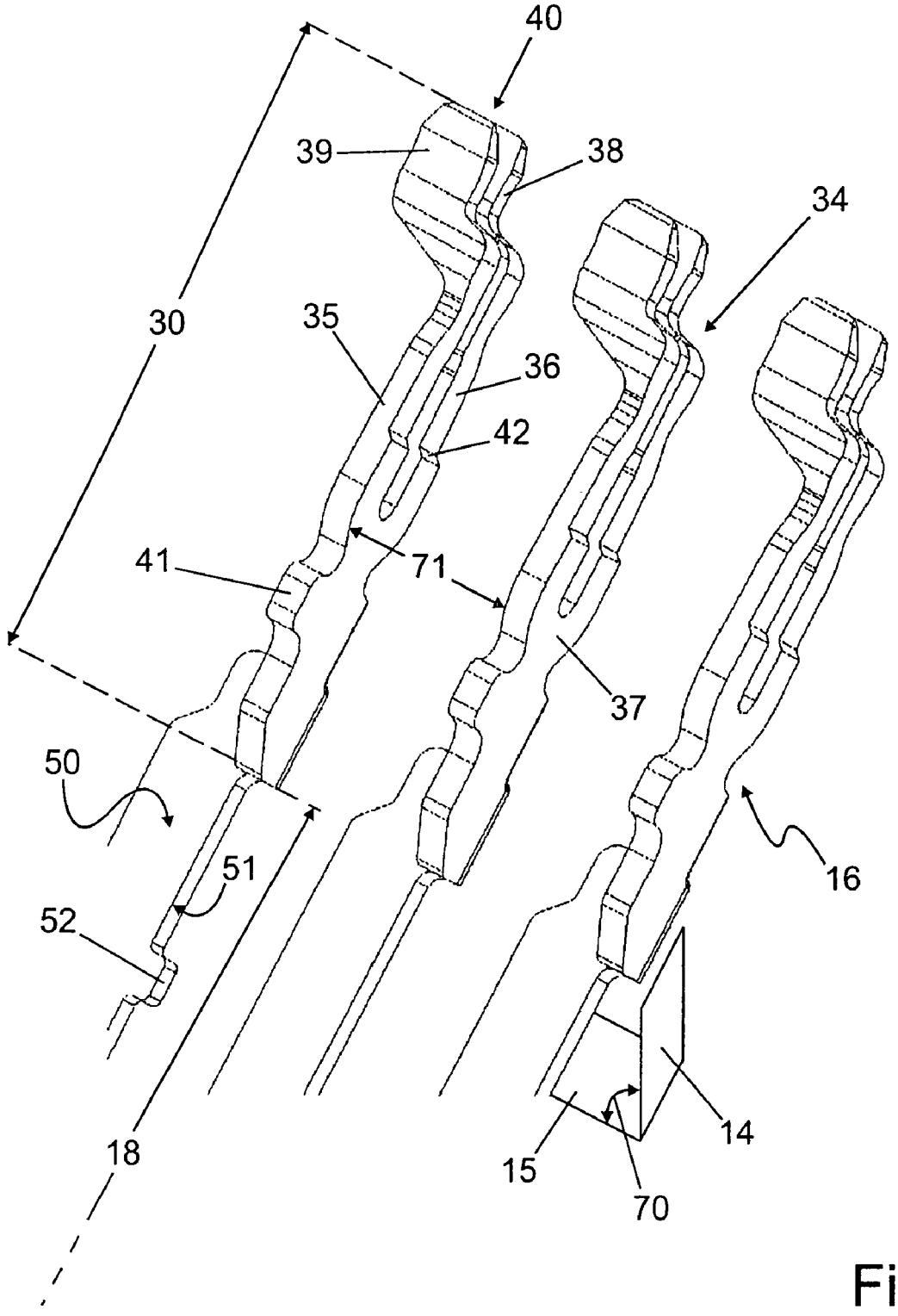
FIG. 4 shows another perspective view of contact elements of a multi-pole plug-in connector according to the invention.

FIG. 4 shows a different perspective view of the contact elements 16 illustrated in FIG. 3. Those parts in FIG. 4 that correspond to the parts illustrated in FIG. 3 are identified by identical reference numerals. Especially, the stepped reduction 42 of the cross-section in the area of the spring legs 35, 36 is clearly visible in FIG. 4.

Figure 5:
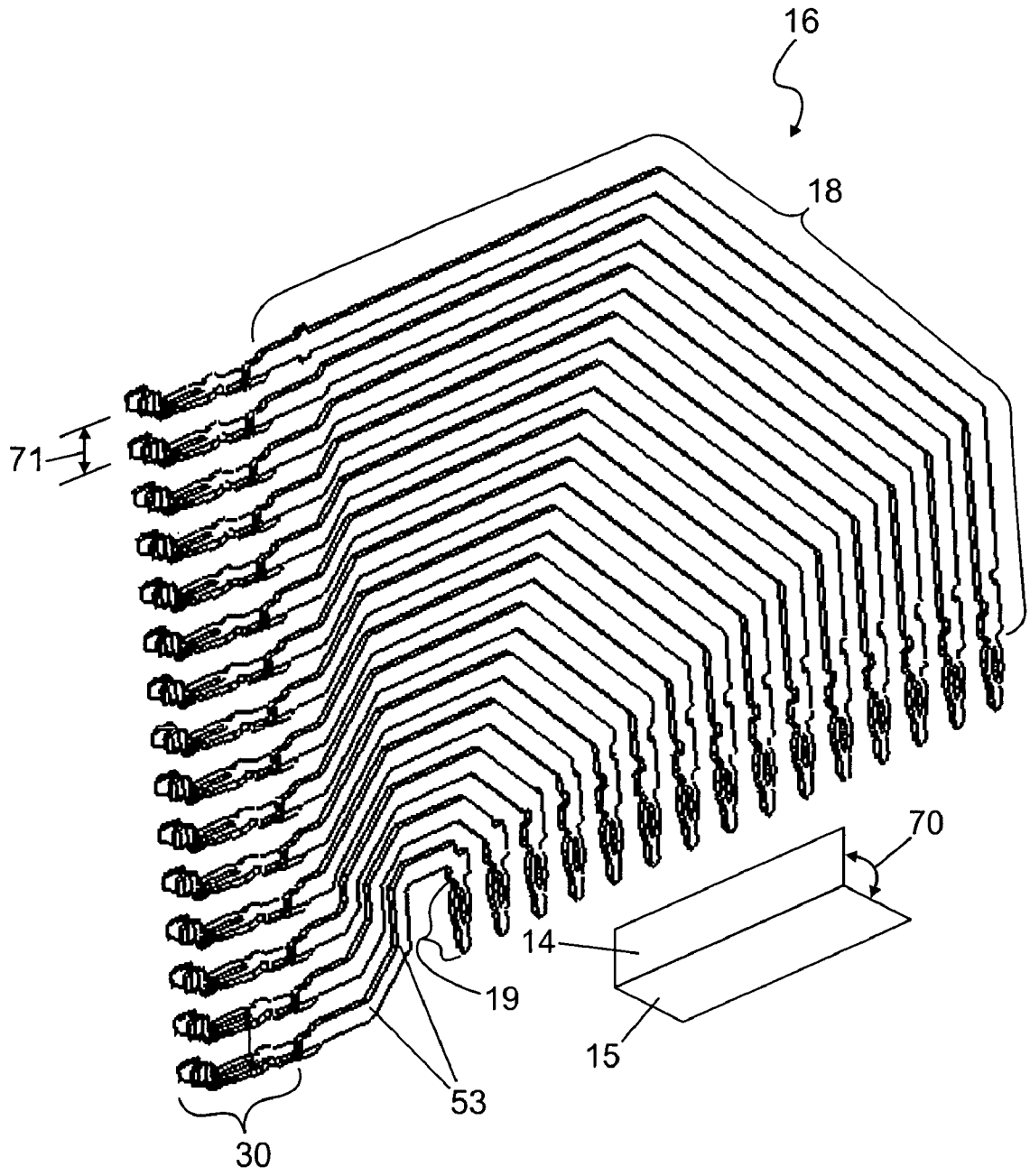
FIG. 5 shows an extended perspective view of contact elements of a multi-pole plug-in connector according to the invention.

FIG. 5 shows an extended perspective view of the contact elements 16 of the multi-pole plug-in connector 10 according to the invention. Those parts in FIG. 5 that correspond to the parts illustrated in the previous figures, are identified by identical reference numerals. FIG. 5 illustrates the way in which the spacing 71 between the contact elements 16 arranged one adjacent the other in the contact column plane 14 can be influenced by the at least one offset 53 in the conduction area 18. Further, FIG. 5 shows an alternative embodiment of the solder area 19, with THR solder connections provided instead of the SMD connections 60 shown in FIG. 2.

Figure 6:
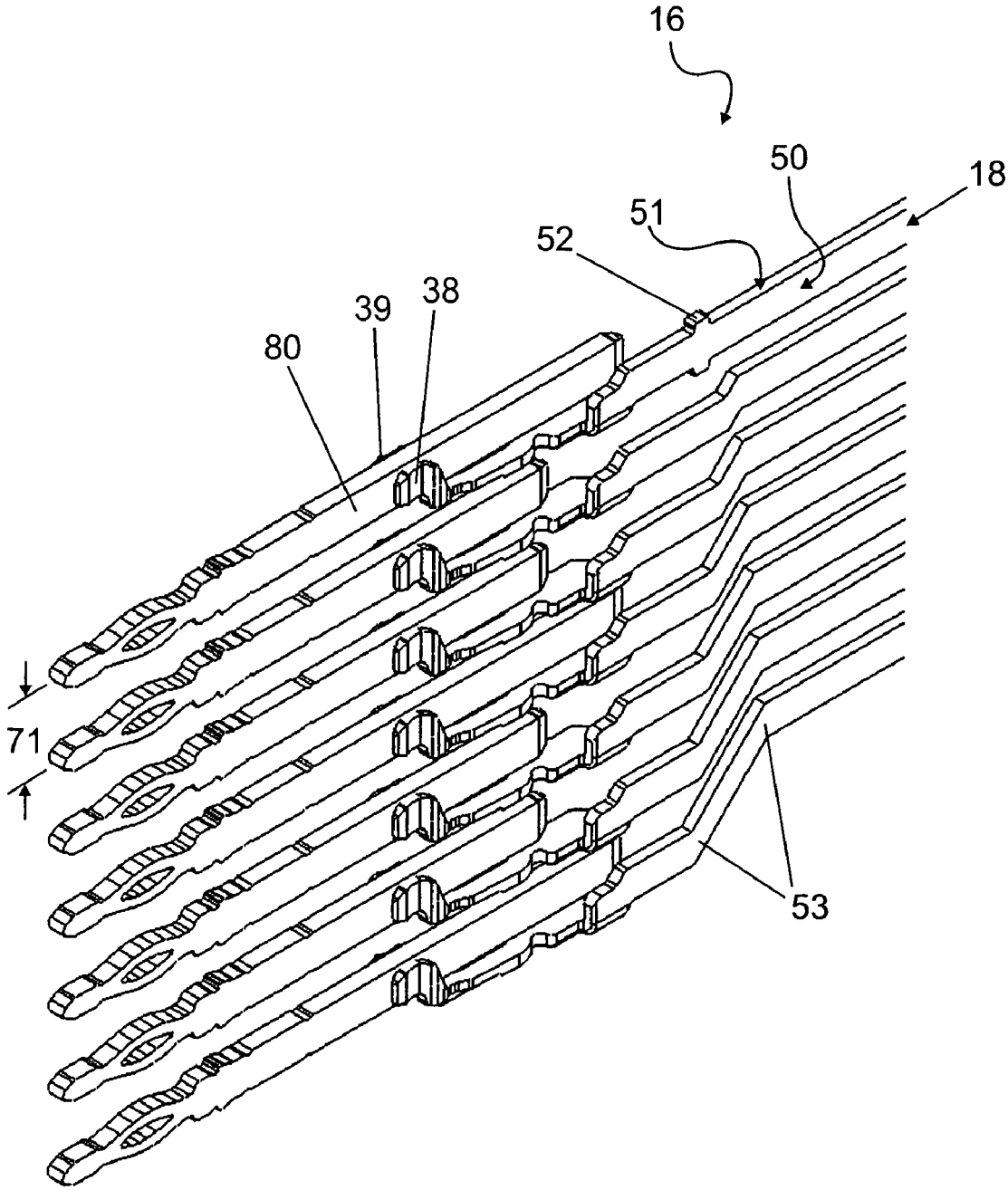
FIG. 6 shows a perspective view of contact elements of a multi-pole plug-in connector according to the invention, in contact with matching contact elements of a corresponding multi-pole plug-in connector.

FIG. 6 shows a perspective view of the contact elements 16 of the multi-pole plug-in connector 10 according to the invention, in contact with corresponding contact elements 80 of a corresponding multi-pole plug-in connector. If the contact elements 16 in the plug-in area 30 are designed as spring elements 34, then the corresponding contact elements 80 are implemented as pins that are locked in place and contacted in the plugged condition by the contact tips 38, 39 of the spring elements 34.

The invention claimed is:

1. Multi-pole plug-in connector having contact elements (16) which comprise a flat plug-in area (30) that transitions to a flat conduction area (18) the wide side (50) of which lies in a contact column plane (14), wherein the wide side (31) of the flat plug-in area (30) is rotated by a predefined angle (70) relative to the wide side (50) of the flat conduction area (l8);

wherein the plug-in area (30) comprises a spring element (34) having two spring legs (35, 36); and wherein the cross-section of the spring legs (35, 36) diminishes substantially continuously, at least by sections, from a connection member (37) of the spring legs (35, 36) in a direction opposite to the plug-in direction (40).

2. The plug-in connector as defined in claim 1, wherein the angle (70) is 90 degrees, at least approximately.

3. The plug-in connector as defined in claim 1, wherein at least two contact elements (16) are arranged one adjacent the other in one contact column plane (14) and the wide side (31) of the plug-in areas (30) and the spacing (71) between the two plug-in areas (30) are matched one to the other purposefully.

4. The plug-in connector as defined in claim 3, wherein the width (33) of the plug-in areas (30) and the spacing (71) between the two plug-in areas (30) are matched one to the other purposefully.

5. The plug-in connector as defined in claim 1, wherein the two spring legs ( 35, 36) lie in one contact row plane (15).

6. The plug-in connector as defined in claim 1, wherein contact tips (38, 39) are provided on the spring legs (35, 36).

7. The plug-in connector as defined in claim 1, wherein the plug-in area (30) comprises at least one plug-in area locking element (41).

8. The plug-in connector as defined in claim 1, wherein the conduction area (18) comprises at least one conduction-area locking element (52).

9. The plug-in connector as defined in claim 1, wherein at least one offset (53) is provided in the contact column plane (14) in the conduction area (18).

10. The plug-in connector as defined in claim 1, wherein a solder area (19) is provided following the flat conduction area (18) of the contact element (16).

11. The plug-in connector as defined in claim 10, wherein the solder area (19) comprises a Surface Mounted Device solder termination.

12. Multi-pole plug-in connector having contact elements (16) which comprise a flat plug-in area (30) that transitions to a flat conduction area (18) the wide side (50) of which lies in a contact column plane (14), wherein the wide side (31) of the flat plug-in area (30) is rotated by a predefined angle (70) relative to the wide side (50) of the flat conduction area (18);

wherein the plug-in area (30) comprises a spring element (34) having two spring legs (35, 36); and wherein a stepped reduction (42) in cross-section, in a direction opposite to the plug-in direction (40), is provided in the area of the spring legs (35, 36).

* * * * *